US005350177A

United States Patent [19]

Furbush, Jr.

[11] Patent Number: 5,350,177

[45] Date of Patent: Sep. 27, 1994

[54] GOLF CLUB SWING TRAINING APPARATUS

[76] Inventor: Norman C. Furbush, Jr., 11425 Dun Loring Pl., Largo, Md. 20772

[21] Appl. No.: 25,742

[22] Filed: Mar. 3, 1993

[51] Int. Cl.[5] ..... A63B 69/36

[52] U.S. Cl. ..... 273/191 R; 273/192; 273/181 R

[58] Field of Search ..... 273/187 R, 183 R, 188 A, 273/187 A, 187 B, 187.1, 191 R, 192

[56] References Cited

U.S. PATENT DOCUMENTS

| | | | |
|---|---|---|---|
| D. 277,886 | 3/1985 | Murphy . | |
| D. 311,568 | 10/1990 | Jacques . | |
| D. 312,117 | 11/1990 | Duncan . | |
| 1,673,339 | 8/1927 | Glennon et al. . | |
| 2,150,580 | 3/1939 | Crowley . | |
| 2,169,407 | 8/1939 | Crowley . | |
| 2,710,757 | 6/1955 | Chong . | |
| 2,934,348 | 4/1960 | Magida . | |
| 2,941,808 | 6/1960 | Smith et al. . | |
| 2,992,005 | 7/1961 | Lockhart . | |
| 3,125,343 | 3/1964 | Price, Jr. et al. . | |
| 3,166,327 | 1/1965 | Champion . | |
| 3,194,565 | 7/1965 | Schroer . | |
| 3,460,837 | 8/1969 | Cassa, Jr. . | |
| 3,550,946 | 12/1970 | Menendez . | |
| 3,561,764 | 2/1971 | Thomas . | |
| 3,580,584 | 5/1971 | Trosko . | |
| 3,586,335 | 6/1971 | D'Antonio, Sr. . | |
| 3,623,733 | 11/1971 | Cavanaugh . | |
| 3,753,563 | 8/1973 | Previte, Jr. . | |
| 3,784,208 | 1/1974 | Weygandt . | |
| 3,934,882 | 1/1976 | Whittaker . | |
| 4,023,811 | 5/1977 | DeCoat . | |
| 4,095,797 | 6/1978 | Breese . | |
| 4,235,440 | 11/1980 | Hinckley . | |
| 4,355,810 | 10/1982 | Rydeck . | |
| 4,384,718 | 5/1983 | Cachola . | |
| 4,478,422 | 10/1984 | Blanchard . | |
| 4,516,779 | 5/1985 | Miller | 273/186.1 |
| 4,526,373 | 7/1985 | Medlock . | |
| 4,718,674 | 1/1988 | Henry | 273/187 R |
| 4,871,175 | 10/1989 | Levin et al. . | |
| 4,913,440 | 4/1990 | Ellington . | |
| 4,921,254 | 5/1990 | Buckley et al. . | |
| 4,927,152 | 5/1990 | Graham . | |
| 4,930,786 | 6/1990 | Bencriscutto . | |
| 4,962,933 | 10/1990 | Awazu et al. . | |
| 5,209,484 | 5/1993 | Randall | 273/192 |

FOREIGN PATENT DOCUMENTS

| | | | |
|---|---|---|---|
| 1488293 | 10/1977 | United Kingdom | 273/186.1 |

*Primary Examiner*—Mark S. Graham
*Attorney, Agent, or Firm*—Richard C. Litman

[57] ABSTRACT

A golf club swing training apparatus provides for several aspects of training in the game of golf with a single relatively simple device. The swing trainer is collapsible, and thus may be carried within a golf bag or the like for use by an individual golfer. The trainer may be unfolded, whereupon the two guides may be aligned with the intended ball trajectory and the guide connecting links adjusted to provide visual alignment cues to the desired trajectory. Adjustable positioning markers may be adjusted to provide assistance in the placement of the ball, the golfer's left and right foot, and the club swing arc, thus defining the proper placement and positioning for the club swing arc to properly strike the ball to drive it along the desired trajectory. A fence extends upward from each guide, so the swing trainer will be displaced if the club head is too far either side of the desired arc. The ball rests directly upon the ground or a tee rather than upon a mat, in order that the path of the ball will not be affected by contact with an artificial surface. The swing trainer may be inverted for putting practice, thus providing clearance for the putted ball to pass beneath any of the components of the swing trainer. The device may also be used to assist in squaring the stance of a golfer.

10 Claims, 2 Drawing Sheets

GOLF CLUB SWING TRAINING APPARATUS

FIELD OF THE INVENTION

This invention relates generally to devices used in the field of training of sports skills, and more specifically to an apparatus or device which may be used to improve the swing and stance of a golfer in performing various strokes.

BACKGROUND OF THE INVENTION

Probably the most difficult problem a novice golfer must face is the need to consistently and accurately swing a given golf club. This need is so critical that it is in fact the basic skill required to properly play the game. Even highly experienced and professional golfers find that they must at least occasionally analyze their swing patterns and correct bad habits, and in fact such a player will sometimes find that "his (or her) game is off," i. e., the player's golf swing has developed some error which must be corrected. Such an error will almost certainly not be prevalent throughout all of the various types of strokes which a golfer must use, but will likely show up in only one aspect of the game, such as driving off the tee, chipping, or putting. In addition, after a player corrects any given error, that player may find that some other aspect of their game needs adjustment due to some error or bad habit which has developed.

Various devices have been developed for the purpose of improving a golfer's swing, as will be more fully described in the Description of the Related Art below. However, most, if not all, of these devices are limited to only one aspect of the game, such as driving off the tee. and cannot be used for the correction of the swing used in other parts of the game. Moreover, very few of these known devices are sufficiently light and portable so as to be easily carried within a typical golf bag where it will be readily accessible to a golfer who wishes to use the device.

The need arises for a golf club swing training apparatus which is sufficiently adaptable so as to be useful in developing or correcting the various types of swings which are used in different areas of the game. The device must be light weight and sufficiently portable so as to be conveniently carried by a golfer for ready access when that golfer wishes to use the device. Additionally, the device should serve to indicate the proper stance for a given golf stroke as the proper stance is essential to a proper swing, and further, that proper stance will vary depending upon the type of stroke desired. Moreover, the device should be relatively inexpensive, thus providing the opportunity for the average player to purchase such a device for his or her own use rather than having to rely on equipment provided by a club or course which may already be in use.

DESCRIPTION OF THE RELATED ART

A multitude of various golf training devices are known in the art. Generally, they may be divided into two broad classifications: Those which comprise a planar mat apparatus upon which the ball is placed either directly or on a tee, and those which comprise a frame or linear alignment apparatus with which the ball is placed directly upon the ground. This is an important distinction, as those devices which provide for ball placement upon a mat preclude a truly authentic practice stroke due to the fact that in all situations other than that of a drive off of a tee, the club head will almost certainly contact the surface to a certain extent. Moreover, when practicing putting strokes, the ball will roll over the surface of such a mat rather than directly upon the green, which results in an unrealistic coefficient of friction as the ball travels over the mat surface. Those patents known to applicant which are generally of the mat type are listed immediately below:

M. J. Glennon et el. U.S. Pat. No. 1,637,339; H. N. Magida U.S. Pat. No. 2,934,348; F. A. Smith et al. U.S. Pat. No. 2,941,808: F. D. Lockhart U.S. Pat. No. 2,992,005; J. B. Schroer U.S. Pat. No. 3,194,565; J. Menendez et al. U.S. Pat. No. 3,550,946; R. A. Thomas U.S. Pat. No. 3,561,764; J. J. D'Antonio, Sr. U.S. Pat. No. 3,586,335; J. J. Cavanaugh U.S. Pat. 3,623,733; J. R. Previte U.S. Pat. No. 3,753,563; M. E. Weygandt U.S. Pat. No. 3,784,208; R. E. Whittaker U.S. Pat. No. 3,934,882; A. F. Hinckley U.S. Pat. No. 4,235,440; J. P. Rydeck U.S. Pat. No. 4,355,810; C. M. Ellington U.S. Pat. No. 4,913,440; and M. Bencriscutto U.S. Pat. No. 4,930,786. No further discussion of this type of training aid will be made due to the irrelevance of such devices to the present invention.

Of those devices which provide a frame or linear alignment apparatus as a golf swing training aid, many fail to provide for any type of stance alignment guide. The following patents known to applicant comprise this group:

S. J. Price, Jr. et al. U.S. Pat. No. 3,125,343; L. F. DeCota U.S. Pat. No. 4,023,811; N. V. Breese U.S. Pat. No. 4,095,797; A. A. Medlock U.S. Pat. No. 4,526,373; J. C. Graham U.S. Pat. No. 4,927,152; and T. Awazu et al. U.S. Pat. No. 4,962,933.

Of the remaining related patents known to applicant, many fail to provide for swing training for putting, in which the ball remains on the surface after being hit with the club head. The devices of this group each contain some structural member which would interfere with the path of a rolling ball, even though a ball in flight might clear any such structural members. As the present invention may be used to refine the putting stroke as well as other golf strokes, this group of patents is not seen to closely relate to the present invention. These patents are listed immediately below:

R. Crowley U.S. Pat. Nos. 2,150,580 and 2,169,407 (although these devices may be modified with a special cross member for use in putting): R. S. Champion U.S. Pat. No. 3,166,327; D. P. Trosko U.S. Pat. No. 3,580,584; and V. F. Blanchard U.S. Pat. No. 4,748,422.

The present invention also provides for a guide or fence arrangement in order to train the golfer in the proper swing arc. The remaining patents and devices known to applicant, while perhaps meeting the above criteria, fail to provide a guide or guides in order to cause the user to properly swing the club. These patents are listed below:

R. H. Cachola U.S. Pat. No. 4,384,718; S. D. Levin et al. U.S. Pat. No. 4,871,175; and G. T. Buckley et al. U.S. Pat. No. 4,921,254.

Of the above patents, the patent issued to Champion is felt to be most closely related to the present invention. However, as noted above several deficiencies are noted in the Champion patent, such as the lack of means providing for complete and compact folding so as to conveniently store in a golf bag, the lack of provision for putting strokes, and the lack of any form of guides or fences which a club head may contact in the event of an improper swing. Moreover, the sides of the device are not inwardly or outwardly adjustable, as they are in the present invention. The present invention provides for each of these functions, as well as others. Thus, none of the above noted patents, either singly or in combination, are seen to disclose the specific arrangement of concepts disclosed by the present invention.

SUMMARY OF THE INVENTION

By the present invention, an improved golf club swing training device is disclosed.

Accordingly, one of the objects of the present invention is to provide an improved swing training device which may be used for any type of golf swing without modification or alteration of the device.

Another of the objects of the present invention is to provide an improved swing training device which provides adjustable markers or other indicia to indicate the proper placement of the feet, ball and club head swing for various types of golf swings or strokes.

Yet another of the objects of the present invention is to provide an improved swing training device which may be easily folded to a compact size for placement within a golf bag or the like.

Still another of the objects of the present invention is provide an improved swing training device which is relatively inexpensive to manufacture, thus providing for ownership and use by individual golfers.

A further object of the present invention is to provide an improved swing training device which provides guides in order for a golfer to learn a proper swing.

Another object of the present invention is to provide an improved swing training device in which such swing guides are adjustable in width, thus allowing for variation in swing tolerances among various golfers.

An additional object of the present invention is to provide an improved swing training device which may be easily modified for use by either left or right handed players.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters designate corresponding parts throughout the several figures of the drawings.

DESCRIPTION OF THE PREFERRED EMBODIMENT

Figure 1:
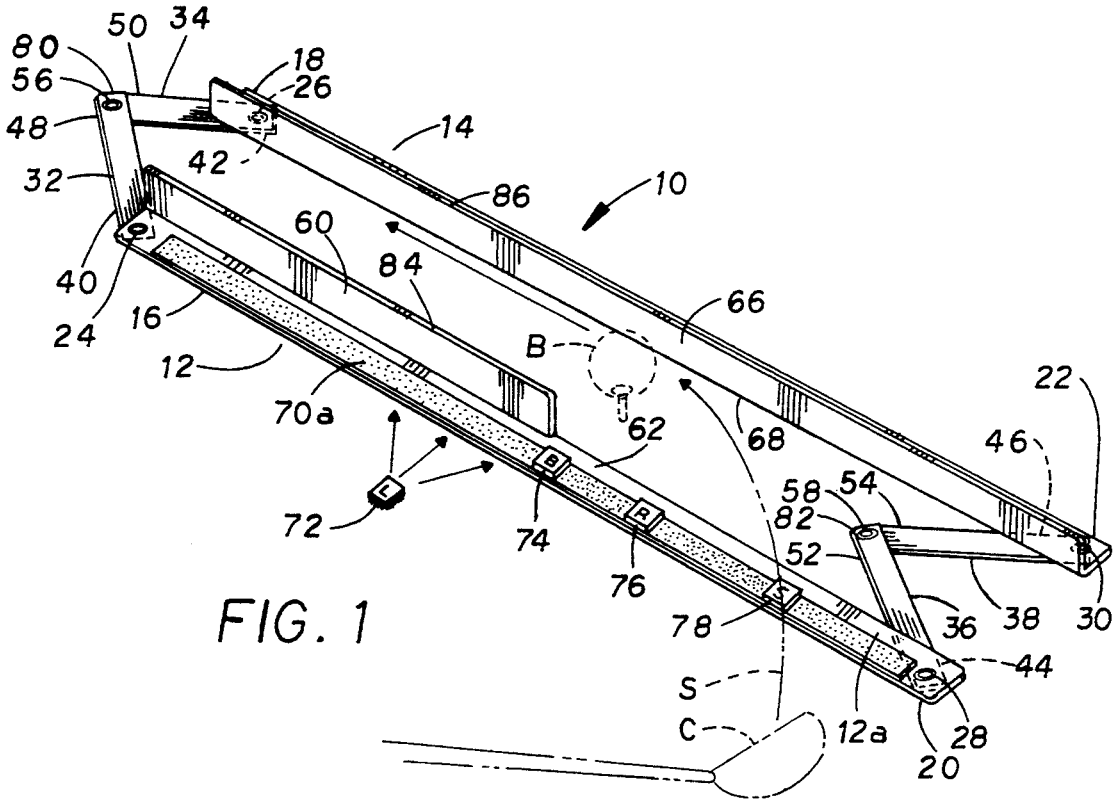
FIG. 1 is a perspective view of the golf swing training device showing its various features and advantages.
Figure 2:
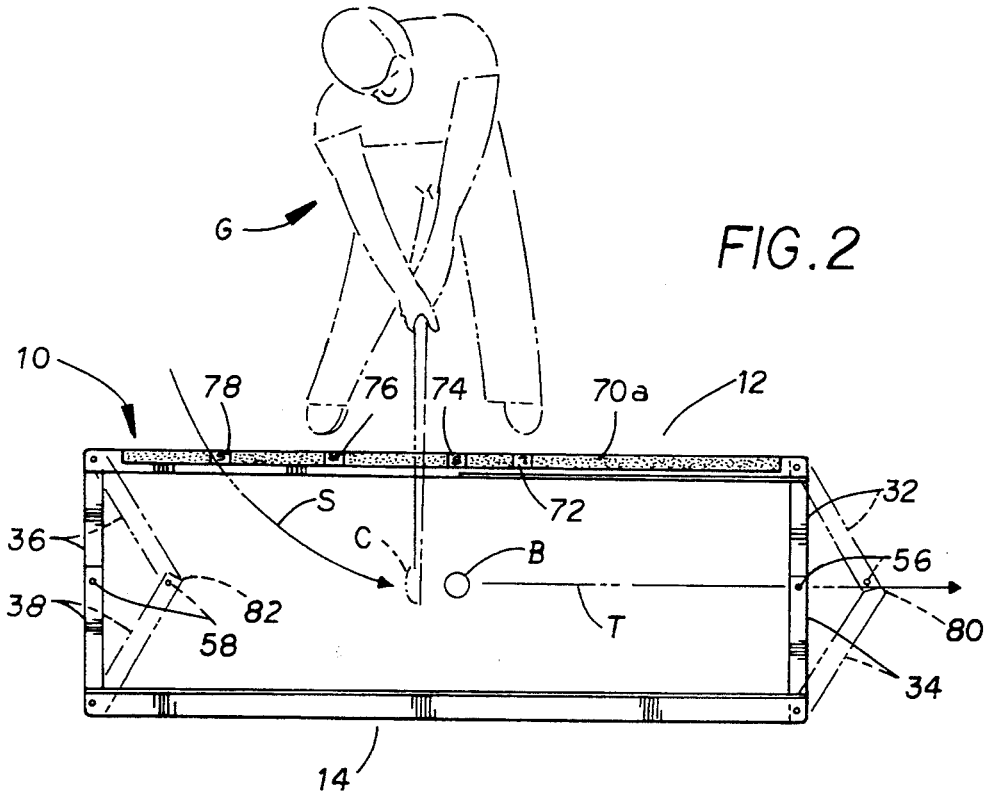
FIG. 2 is a top view of the swing trainer in use, with the golfer using the trainer shown in a much reduced scale.
Figure 3:
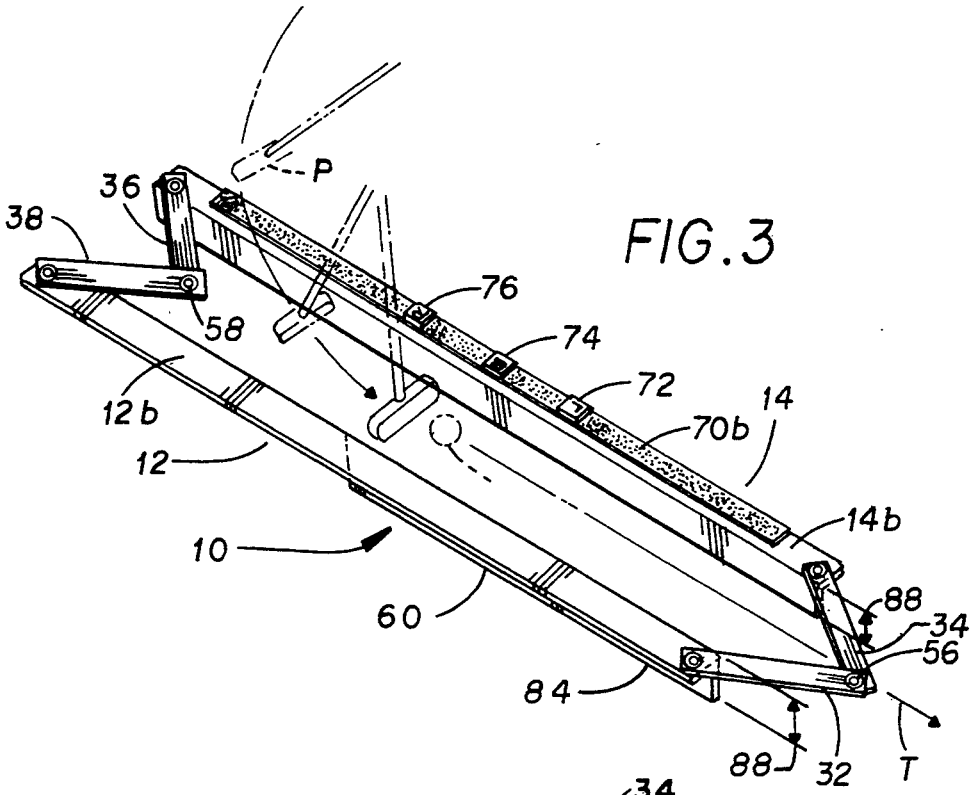
FIG. 3 is a perspective view of the swing trainer in use as a putting stroke trainer.
Figure 4:
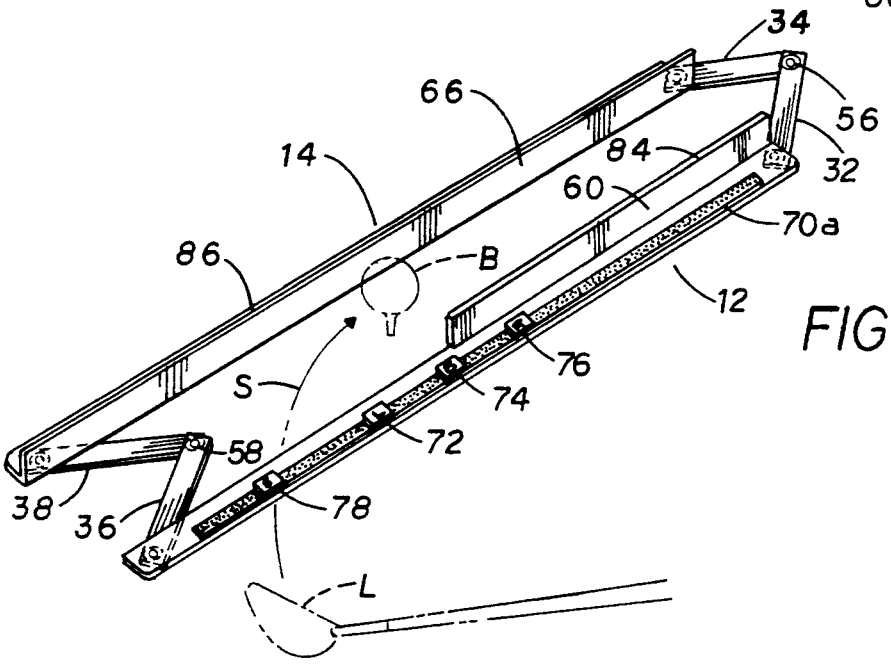
FIG. 4 is a perspective view of an embodiment of the swing trainer for left handed golfers.

Referring now to the drawings, particularly FIG. 1 of the drawings, the present invention will be seen to relate to an improved golf club swing training apparatus or device 10. Swing trainer 10 basically comprises an inner guide 12 and an outer guide 14 and interconnecting means described further below. It should be noted at this point that the term "inner" refers to the guide 12 which is normally nearest the golfer (noted as G in FIG. 2) when swing trainer 10 is in use. Conversely, the term "outer" refers to the guide 14 which is normally farthest from golfer G when trainer 10 is in use. A variation on this convention is shown in FIGS. 3, where swing trainer 10 is shown inverted for use as a putting trainer, and FIG. 5, where swing trainer 10 is shown in use as a stance corrective device. It will be obvious to those versed in the game of golf that the trainer 10 shown in FIGS. 1 through 3 is patterned for use by a right handed player, and that trainer 10 may just as easily be formed for use by a left handed player as shown in FIG. 4. The variations involved will be more fully described further below.

Inner guide 12 and outer guide 14 respectively have forward ends 16 and 18, and rearward ends 20 and 22. These ends 16 through 22 are pivotally connected to the interconnecting means respectively at pivots 24 through 30.

The interconnecting means briefly noted above comprise an inner and outer forward link 32 and 34 respectively, and an inner and outer rearward link 36 and 38 respectively. Links 32 through 34 each have guide attachment ends 40 through 46 respectively, which are respectively pivotally attached at pivots 24 through 30 to inner and outer guides 12 and 14. These interconnecting links 32 through 38 also possess link connecting ends, designated respectively as 48 through 54 for links 32 through 38, which connecting ends 48 and 50 for forward links 32 and 34 are pivotally joined by pivot 56 and for rearward links 36 and 38 are joined by pivot 58.

Inner guide 12 is preferably formed of a length of flat material, as are outer guide 14 and links 32, 34, 36 and 38. However, inner guide 12 also provides a vertical inner guide fence 60 which preferably extends upward from the inner edge 62 of inner guide 12 and extends from approximately the midpoint 64 of inner guide 12, forward to the forward end 16 of inner guide 12. Outer guide 14 also provides a vertical outer guide fence 66 which preferably extends upward from the inner edge 68 of outer guide 14, and is formed along the entire length of outer guide 14. The reason for this difference in lengths between guide fences 60 and 66 will be explained further below.

Inner guide 12 provides further for the removable placement of various markers 72 through 78 or other suitable devices which may be temporarily secured to the upper surface **12*a* of inner guide 12. The securing means may be a hook and loop material such as a VELCRO strip 70*a* or other similar material which is installed along the upper surface 12*a* of inner guide 12, or alternatively a series of snap fasteners (not shown) or any other suitable attachment means may be used. A similar securing means 70*b* may also be installed along the lower surface 12*b* of inner guide 12 or alternatively along the lower surface 14*b* of outer guide 14, as shown in FIG. 3. The alternative location for securing means 70*b* on either lower surface 12*b* or 14*b* of inner or outer guide 12 or 14 will have no bearing on the function of swing trainer 10 when used as shown in FIG. 3**.

Securing means **70*a* or 70*b* provides for the temporary attachment of markers 72 through 78 which provide placement information for a golfer G relating to his or her stance, swing alignment, and ball placement. Marker 72, designated as "L," may be used to indicate to golfer G the proper placement of the left foot when addressing golf ball B, which ball B placement is indicated the position of marker 74, designated as "B". In a similar manner, marker 76 (designated as "R") is used to properly position the right foot, and marker 78 (designated as "S") is used to properly align the swing arc or stroke S of club head C. Each of these markers 72 through 78 is backed with a mating material or fastening device which enables the markers to be placed as desired along inner guide 12**.

It will be appreciated that the pivotal attachment of links 32 through 38 to inner and outer guides 12 and 14 serve to permit swing trainer 10 to be collapsed in order that guides 12 and 14 will be immediately adjacent one another, rather than spaced apart as they would be when swing trainer 10 is in use. This folding or collapsing feature allows swing 10 to be easily stored and carried within a golf bag or the like.

Swing trainer 10 is typically used at a golf course, driving range or similar area. Swing trainer 10 may be removed from storage and opened in order to space inner and outer guides 12 and 14 apart as desired. Normally, guides 12 and 14 will be spaced apart less than the maximum amount which would be obtainable by extending links 32 through 38 to their maximum extent. This partially folded condition offers yet another advantageous feature, in that links 32 through 38 may be angled as shown in FIGS. 1, 3 and 4 to form a forward apex 80 and rearward apex 82 which will normally be aligned with the desired trajectory T of ball B. At the same time, inner and outer guides 12 and 14 are preferably adjusted so as to be parallel with one another and swing trainer 10 is placed upon the ground or playing surface with inner and outer guides 12 and 14 preferably parallel to the desired trajectory T of ball B.

Swing trainer 10 may be placed either around a ball B which is on the playing surface, or alternatively ball B may be teed up and/or placed within swing trainer 10 after trainer 10 has been placed upon the surface. Markers 72 through 76 may then be temporarily installed upon securing means 70*a* or 70*b* in order to mark the appropriate position for ball B, and the relative desired positions for the left and right foot of golfer G as he or she addresses the ball B.

Assuming that a stroke which will cause ball B to leave the surface is desired, marker 78 denoting the appropriate point over which the club head C is to be swung is also installed upon securing means 70*a*. Normally, swing marker 78 will not be used upon securing means 70*b* as shown in FIG. 3, as will be explained further below. As a club head C normally forms a generally circular arc S both during the back swing and forward swing of the club, and as such a swing arc S normally lies in a plane which is at some angle between the vertical and horizontal, it will be seen that basic geometry dictates that at a given radius, angle and central point of swing arc S as defined by markers 72, 76 and 78, if club head C passes over a properly positioned swing marker 78, club head C will also strike ball B properly so as to send ball B along the desired trajectory T. Such radius and angle are of course defined by the length of the club shaft being used, as well as the individual golfer. Moreover, markers 72 through 78 may be repositioned as desired in order to refine the above action, and once the proper swing arc S and ball trajectory T are established, the action is repeatable due to the constant reference points provided by swing trainer 10 and markers 72 through 78.

The above description will serve to show why inner guide fence 60 extends only from approximately the midpoint 64 to the forward end 16 of inner guide 12. In performing those strokes described above, the arc followed by club head C may interfere with any rearward extension of inner guide fence 60. This would be particularly true of shots made with the shorter distance irons, where the portion of the swing prior to contact with ball B will generally be lower. Conversely, the follow through after club head C contacts ball B will generally be rising, and thus clear inner guide fence 60.

It will be seen that any significant lateral error in the swing stroke or arc S of club head C will result in club head C striking either inner or outer guide fence 60 or 66, thus causing swing trainer 10 to be displaced from its resting place upon the surface. The type of error involved in swing stroke S will be immediately obvious to the player using swing trainer 10 under such circumstances, due to the direction of displacement of swing trainer 10 after either of the guide fences 60 or 66 is struck by club head C. Accordingly, adjustments may be made in swing stroke S by adjusting the placement of one or more of markers 72 through 78 in an appropriate manner. When swing stroke S has developed sufficient consistency that contact with either guide fence 60 or 66 by club head C is rare, the distance between inner and outer guides 12 and 14 may be narrowed in order to require even greater accuracy by the user. Thus, an extremely accurate and consistent swing stroke S may be developed through the use of swing trainer 10.

Normally, a ball B which is struck by any of the wood or iron type clubs will leave the surface in flight and thus pass above forward links 32 and 34. This is of course not true when putting, thus means must be provided in order to allow ball B to roll continuously along the surface without contacting or passing over forward links 32 and 34. This is easily accomplished with the present invention by merely inverting swing trainer 10 in a manner that swing trainer 10 will rest upon the inverted upper edges 84 and 86 respectively of inner and outer guide fences 60 and 66, as shown in FIG. 3. Guide fences 60 and 66 are of sufficient height 88 so as to raise forward links 32 and 34 above the height of a golf ball B which may roll along the surface after being struck by putter head P, thus allowing ball B to clearly pass beneath links 32 and 34 without contacting them or any other components of swing trainer 10.

It will also be appreciated by those skilled in the art that the inclusion of marker 78, denoting the swing arc, is unnecessary when swing trainer is used for putting as shown in FIG. 3. Generally, the swing arc used when putting is more vertical than that used with other golf strokes, thus putter head P will easily clear the raised guide 14 when swing trainer 10 is used in the inverted position for putting practice as shown in FIG. 3. Moreover, the backstroke used in such putting strokes is relatively short, so no clearance problems arise in this particular method of use.

It can be difficult for the left handed golfer to find proper training, as the overwhelming majority of golfers, particularly professionals and instructors, are right handed. Swing trainer 10 may be easily modified to the configuration shown in FIG. 4 for use by left handed players. This embodiment involves nothing more than the placement of inner guide fence 60 along the opposite portion of inner guide 12 than that used for right handed golfers. The general nomenclature remains the same in both embodiments, although it will be seen that the embodiment for use by a left handed golfer is essentially a mirror image of that for use by a right handed golfer.

Figure 5:
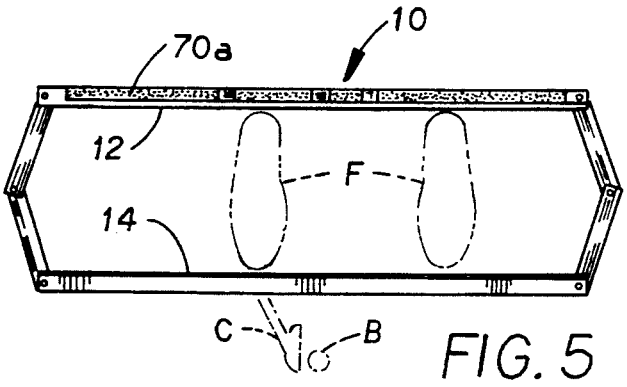
FIG. 5 is a top view of the swing trainer in use as a stance corrective device.

Swing trainer 10 may be used further as a device to assist a golfer to square his stance, as shown in FIG. 5. It is well established that the standard stance for addressing the ball when playing the game of golf, is with the feet somewhat spread along a line which is parallel to the intended path of the ball. Swing trainer 10 may be used for this purpose by spreading inner and outer guides 12 and 14 a distance apart which is approximately equal to the length of the shoes F of the player using swing trainer 10. Swing trainer 10 may then be placed on the surface where the player is to address the ball B, and aligned with the intended trajectory of the ball as described above. The player may then stand within swing trainer 10 to address ball B with the assurance that his or her stance is properly squared relative to the desired trajectory of the ball. It will be noted that in FIG. 5, swing trainer 10 has been positioned so that guide 12 which is equipped with securing means **70*a* is located behind the player, rather than in front as in other figures. Swing trainer 10 is provided with sufficient versatility that it may be used in this manner as a stance corrective device. However, guide 12 with securing means 70*a* may also be placed in front of the player when swing trainer 10** is being used as a stance corrective device, if so desired.

It is to be understood that the present invention is not limited to the sole embodiment described above, but encompasses any and all embodiments within the scope of the following claims.

I claim:

1. A collapsible and adjustable golf club swing training apparatus for use by a golfer in positioning the stance and golf club awing arc of said golfer relative to a grounded or teed golf ball positioned upon a playing surface in order to propel said golf ball by means of said golf club along a desired trajectory, said swing training apparatus comprising;

an inner guide and an outer guide, said inner and outer guides each having a forward end, a rearward end, and a midpoint, adjustable positioning markers secured to said inner guide, inner and outer forward and inner and outer rearward connecting links, each of said connecting links having a guide connecting end and a link connecting end, said inner and outer forward connecting link guide connecting ends respectively pivotally attached to said inner and outer guide forward ends, said forward connecting links pivotally attached to one another at said forward link connecting ends, said rearward connecting links pivotally attached to one another at said rearward link connecting ends, said inner and outer guides each having a guide fence extending upward therefrom, wherein said inner guide fence is substantially shorter in length than said outer guide fence, said inner guide having an upper surface providing securing means for said adjustable positioning markers, whereby said swing training apparatus provides adjustable positioning guidance for said stance and said club swing arc of said golfer.

2. A golf club swing training apparatus according to claim 1 wherein:

said adjustable positioning markers comprise at least left foot, right foot, golf ball and club swing arc positioning markers.

3. A golf club swing training apparatus according to claim 1 wherein;

said adjustable positioning marker securing means comprises hook and loop material.

4. A golf club swing training apparatus according to claim 1 wherein:

said guide fences extend upward to a height greater than that of said golf ball resting upon said playing surface.

5. A golf club swing training apparatus according to claim 1 wherein;

said inner and outer guides each have an inner edge, and said guide fences extend upward from said guide inner edges.

6. A golf club swing training apparatus according to claim 1 wherein;

said inner guide has a lower surface, and said inner guide lower surface includes said securing means for said adjustable positioning markers.

7. A golf club swing training apparatus according to claim 1 including;

adjustable spacing between said inner and outer guides.

8. A method of use of a golf club swing training apparatus including an inner guide having an inner forward end, an inner rearward end, and in inner fence extending from the inner forward end to an end at a location between the inner forward end and the inner rearward end; an outer guide having an outer forward end, an outer rearward end, and an outer fence extending from the outer forward end to the outer rearward end; an inner forward connecting link; an inner rearward connecting link; an outer forward connecting link; an outer rearward connecting link; and a plurality of adjustable positioning markers; comprising the steps of:

extending the forward and rearward connecting links to spread the inner and outer guides apart, adjust the inner and outer guides in parallel, adjusting the forward connecting links to form an angle having apex therebetween, adjusting the rearward connecting links to form an angle having an apex therebetween, placing the golf club swing training apparatus upon the surface with the inner and outer guides parallel to and either side of the golf ball and the desired trajectory, orientating the apices along the desired trajectory and thus providing visual alignment guides, adjusting the adjustable positioning markers as desired, adjusting the stance and the club swing arc of the golfer to comply with the positioning markers and the golf ball, and swinging the golf club according to the positioning markers and thus causing the golf ball to travel along the desired trajectory.

9. The method according to claim 8 further comprising the steps of:

inverting said golf swing training apparatus to orient said guide fences downward, placing said golf club swing training apparatus upon the surface with said inner and outer guides parallel to and either said of the golf ball and the desired trajectory and with the guide fences resting upon the surface and the forward connecting links and the rearward connecting links above the surface, and putting the golf club according to the positioning markers and thus causing the golf ball to travel continually over the surface along the desired trajectory and beneath the forward connecting links.

10. A method of use of a golf club swing training apparatus including an inner guide having an inner forward end, an inner rearward end, and an inner fence extending from the inner forward end to an end at a location between the inner forward end and the inner rearward end; an outer guide having an outer forward end, an outer rearward end, and an outer fence extending from the center forward end to the outer rearward end; an inner forward connecting link; an inner rearward connecting link; an outer forward connecting link; an outer rearward connecting link; and a plurality of adjustable positioning markers; comprising the steps of:

extending the forward and rearward connecting links to spread the inner and outer guides apart, adjusting the inner and outer guides in parallel a sufficient distance apart to closely fit the stance of the golfer, placing the golf club swing training apparatus upon the surface with the inner and outer guides beside the golf ball and parallel to the desired trajectory, placing the stance of the golfer within the golf club swing training apparatus, adjusting the stance of the golfer to comply with the inner and outer guides, and swinging the golf club according to the stance thus developed and thus causing the golf ball to travel along the desired trajectory.

* * * * *